US009570841B2

(12) United States Patent
Kitamura et al.

(10) Patent No.: US 9,570,841 B2
(45) Date of Patent: Feb. 14, 2017

(54) CONNECTOR STRUCTURE AND WIRING HARNESS

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Keishi Kitamura, Mie (JP); Yoshihiro Mizutani, Mie (JP); Yasuto Takeda, Mie (JP); Hiroki Hirai, Mie (JP); Tetsuji Tanaka, Mie (JP); Hiroyoshi Maesoba, Mie (JP); Kosuke Sone, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 15/027,020

(22) PCT Filed: Oct. 6, 2014

(86) PCT No.: PCT/JP2014/076653
§ 371 (c)(1),
(2) Date: Apr. 4, 2016

(87) PCT Pub. No.: WO2015/060109
PCT Pub. Date: Apr. 30, 2015

(65) Prior Publication Data

US 2016/0240963 A1 Aug. 18, 2016

(30) Foreign Application Priority Data

Oct. 25, 2013 (JP) ..... 2013-221772

(51) Int. Cl.
*H01R 13/58* (2006.01)
*H01R 13/72* (2006.01)

(52) U.S. Cl.
CPC ..... *H01R 13/5833* (2013.01); *H01R 13/72* (2013.01)

(58) Field of Classification Search
CPC . H01R 13/72; H01R 13/5833; H01R 2103/00; H01R 13/501

(Continued)

(56) References Cited

U.S. PATENT DOCUMENTS 7,210,964 B2 * 5/2007 Morris ..... H01R 9/032 439/471
7,661,982 B2 * 2/2010 Tachi ..... H01R 13/56 439/471

(Continued)

FOREIGN PATENT DOCUMENTS

JP 11-329576 11/1999
JP 2003-32866 1/2003

(Continued)

OTHER PUBLICATIONS

International Search Report.

*Primary Examiner* — Edwin A. Leon
(74) *Attorney, Agent, or Firm* — Gerald E. Hespos; Michael J. Porco; Matthew T. Hespos

(57) ABSTRACT

It is aimed to enable a connecting operation to smoothly proceed by preventing erroneous connection of a connector (10). A connector structure includes a housing (20) in which a terminal fitting (60) is to be accommodated, a wire (70) to be connected to the terminal fitting (60) and pulled out from a wire pull-out surface (24) of the housing (20), and an extra-length adjusting portion (21) provided continuously to the housing (20) and configured to hold the wire (70) pulled out from the wire pull-out surface (24) in a state loosened (Continued)

into a substantially U shape or wounded one or more turns and variably adjust the amount of loosening or winding of the wire.

5 Claims, 7 Drawing Sheets

(58) Field of Classification Search
USPC ..... 439/456, 450, 733.1
See application file for complete search history.

(56) References Cited

U.S. PATENT DOCUMENTS

| | | | | |
|---|---|---|---|---|
| 9,054,449 | B2 * | 6/2015 | Utz ..... | H01R 13/5812 |
| 2001/0052442 | A1 | 12/2001 | Tsukamoto | |

FOREIGN PATENT DOCUMENTS

| | | |
|---|---|---|
| JP | 2003-163057 | 6/2003 |
| JP | 2005-192381 | 7/2005 |
| JP | 2007-035526 | 2/2007 |
| JP | 2009-093860 | 10/2007 |
| JP | 2010-040199 | 2/2010 |
| JP | 2012-085414 | 4/2012 |

* cited by examiner

CONNECTOR STRUCTURE AND WIRING HARNESS

BACKGROUND

1. Field of the Invention

The present invention relates to a connector structure and a wiring harness including a plurality of connectors having the connector structure.

2. Description of the Related Art

Japanese Unexamined Patent Publication No. 2009-93860 discloses a configuration in which a wire cover is mounted on a rear end part of a connector. The wire cover includes a wire accommodating portion in the form of a rectangular box for accommodating a wire extending from the rear surface of the connector. A wire pull-out opening is open on each of upper, lower, left and right surfaces of the wire accommodating portion and an opening lid capable of opening and closing the wire pull-out opening is coupled to a front end part of the wire pull-out opening via a hinge. In this case, out of the four wire pull-out openings, the opening lids for three wire pull-out openings are closed, whereas the opening lid for one wire pull-out opening is open and the wire extending from the connector is pulled out through the one open wire pull-out opening. Then, the wire is led out to outside from the wire pull-out opening in a direction intersecting with a connecting direction to a mating connector.

In the above case, an extended end of the wire led out to outside from the wire pull-out opening is introduced into another connector. At this time, for example, if a length of the wire arranged between the two connectors is shorter than a proper length, the wire is arranged in a tense manner between the two connectors and it is difficult to locate the connector at a position right opposite to the mating connector during connection. On the other hand, if the length of the wire arranged between the two connectors is longer than the proper length, the wire is arranged in a loose manner and the handling of the wire during the connection of the two connectors is cumbersome. As a result, if the length of the wire arranged between the two connectors is not properly adjusted, a connecting operation of the two connectors cannot smoothly proceed.

The present invention was completed based on the above situation and aims to enable a connecting operation of connectors to smoothly proceed.

SUMMARY

A connector structure of the present invention includes a housing in which a terminal fitting is to be accommodated, a wire to be connected to the terminal fitting and pulled out from a wire pull-out surface of the housing, and an extra-length adjusting portion provided continuously to the housing and configured to hold the wire pulled out from the wire pull-out surface in a state loosened into a substantially U shape or wounded one or more turns and variably adjust the amount of loosening or winding of the wire.

Since the wire pulled out from the wire pull-out surface of the housing is held in the extra-length adjusting portion while the amount of loosening or winding thereof is variably adjusted, a length of the wire arranged between two connectors via the wire is properly adjusted. As a result, a state where the connector is facing right opposite to a mating connector during connection can be ensured and a connecting operation of the connector and the mating connector can smoothly proceed. Note that the connector is configured by parts of the connector structure excluding the wire.

The extra-length adjusting portion includes a support configured to contact the wire against a resilient restoring force of the wire. A loosened or wound state of the wire in the extra-length adjusting portion is maintained reliably by the contact of the wire with the supporting portion.

The wire may include in the extra-length adjusting portion, a first extended portion extending in a first direction intersecting with a connecting direction of the housing and a mating housing and a second extended portion turned at an extended end of the first extended portion and extending in a second direction opposite to the first direction. Additionally, the extra-length adjusting portion may include a partition between the first and second extended portions. The partition ensures that the first and second extended portions are not mixed in the extra-length adjusting portion is avoided.

The extra-length adjusting portion may comprise a base projecting from the housing, the partition projecting from a base end side of the base in a projecting direction while facing the wire pull-out surface, and a support projecting from a tip side of the base in the projecting direction while facing the wire pull-out surface and at a position to contact the wire against a resilient restoring force of the wire. The partition ensures that the first and second extended portions are not mixed and the support reliably maintains the loosened or wound state of the wire, while the extra-length adjusting portion is allowed to have a simple structure.

A wiring harness includes a plurality of connectors having the above connector structure. The connectors are arranged parallel to a connecting direction of the housing and a mating housing and are spaced apart in a direction intersecting the connecting direction. The extra-length adjusting portion has an area for holding the wire pulled out from the wire pull-out surface of the housing of a first of the connectors and an area for allowing the passage of the wire pulled out from the wire pull-out surface of the housing of another of the connectors. Thus, the respective wires are collectively arranged in a compact manner in the extra-length adjusting portion.

The wires have rigidity capable of maintaining linearity and function as an aligning member configured to align each of the connectors at a position right opposite to the mating housing. This enables the connecting operation to proceed smoothly from a state where each connector is facing right opposite to the mating housing. Further, since it is not necessary to prepare a dedicated aligning member, and the overall configuration can be simplified.

DETAILED DESCRIPTION

Figure 1:
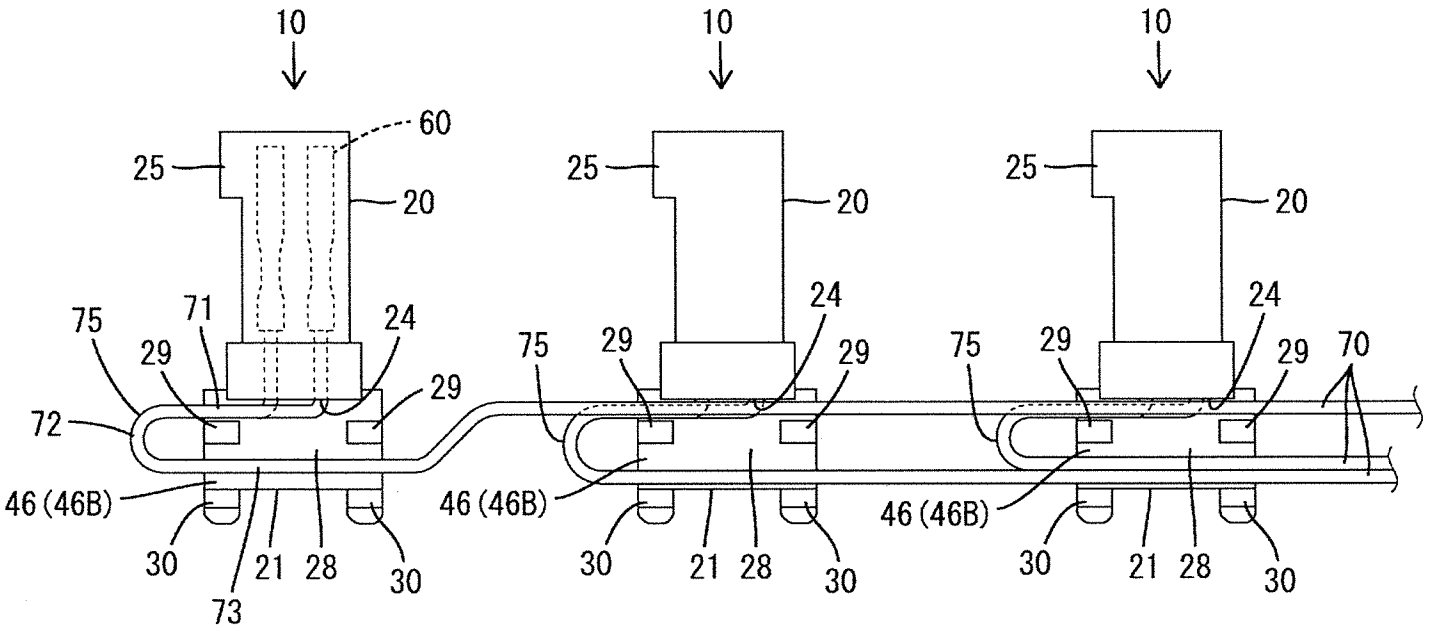
FIG. 1 is a plan view showing a state where connectors are arranged in parallel via wires in an embodiment of the present invention.

An embodiment of the present invention is described with reference to FIGS. 1 to 8. A connector 10 of the embodiment includes a housing 20 made of synthetic resin, unillustrated terminal fittings 60 capable of being accommodated in the housing 20, an extra-length adjusting portion 21 provided continuously to the housing 20 and a separate cover 40 to be mounted on the extra-length adjusting portion 21. As shown in FIG. 1, the terminal fittings 60 are connected to ends of wires 70 and the housing 20 is connectable to a mating housing 80. Note that, in the following description, a facing side of the housing 20 toward the mating housing 80 at the start of connection is referred to as a front side concerning a front-back direction.

Figure 8:
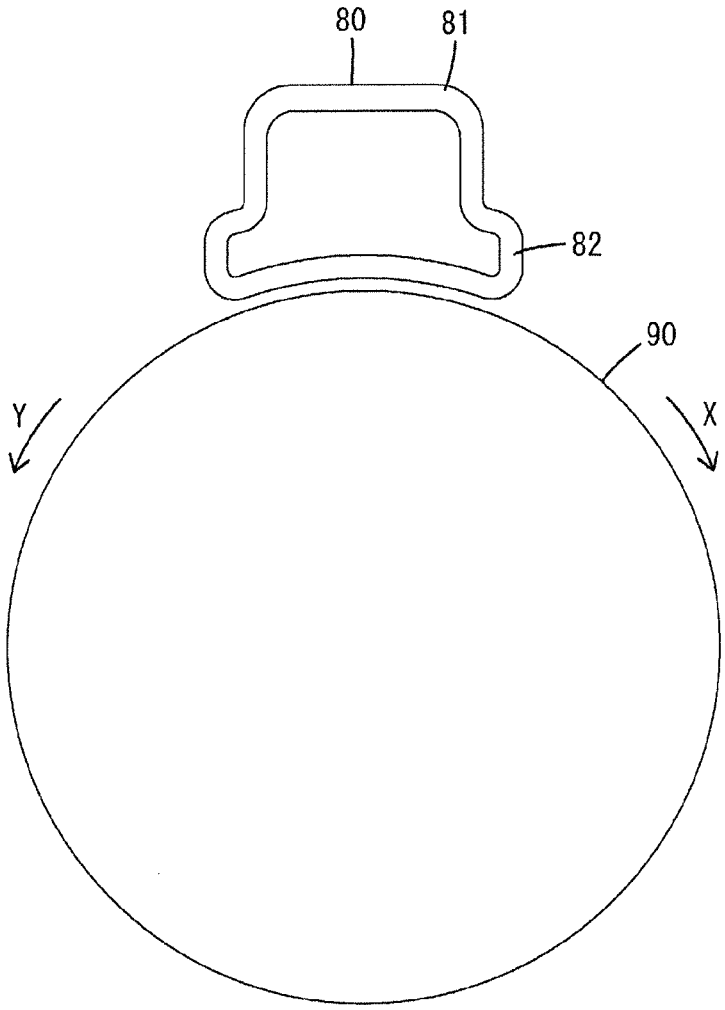
FIG. 8 is a schematic front view of a mating housing.

As shown in FIG. 8, the mating housing 80 includes a tubular receptacle 81 made of synthetic resin. Unillustrated mating terminal fittings are arranged to project into the receptacle 81. Further, an extended portion 82 is provided to protrude laterally in a lower end part of the receptacle 81. The mating housing 80 is disposed on the outer peripheral surface of a solenoid 90 having a substantially cylindrical shape. A plurality of solenoids 90 are disposed side by side in a component constituting an unillustrated automatic transmission. The mating housing 80 is provided for each solenoid 90 and has a bottom surface curved along the outer peripheral surface of the solenoid 90.

Figure 3:
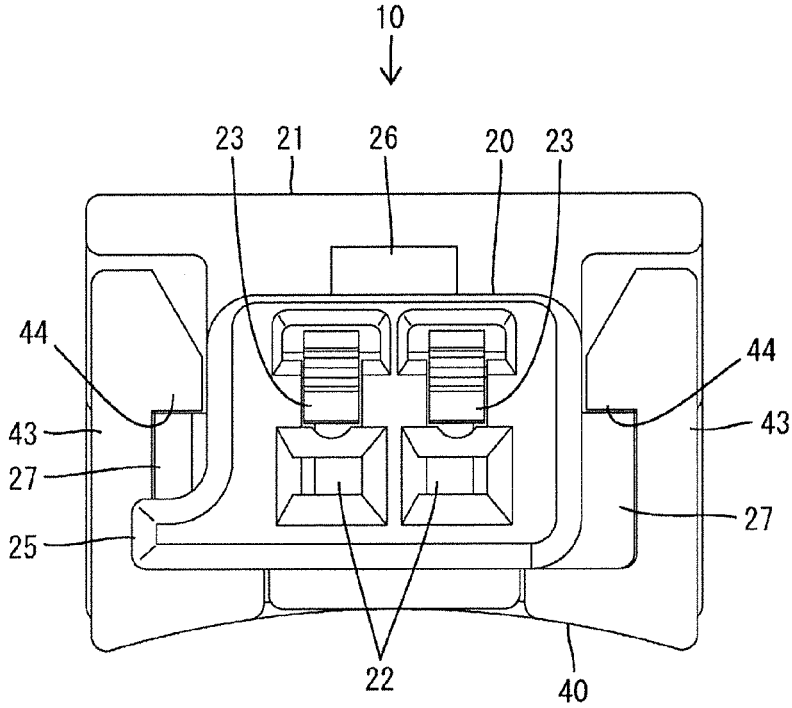
FIG. 3 is a front view of the connector.
Figure 7:
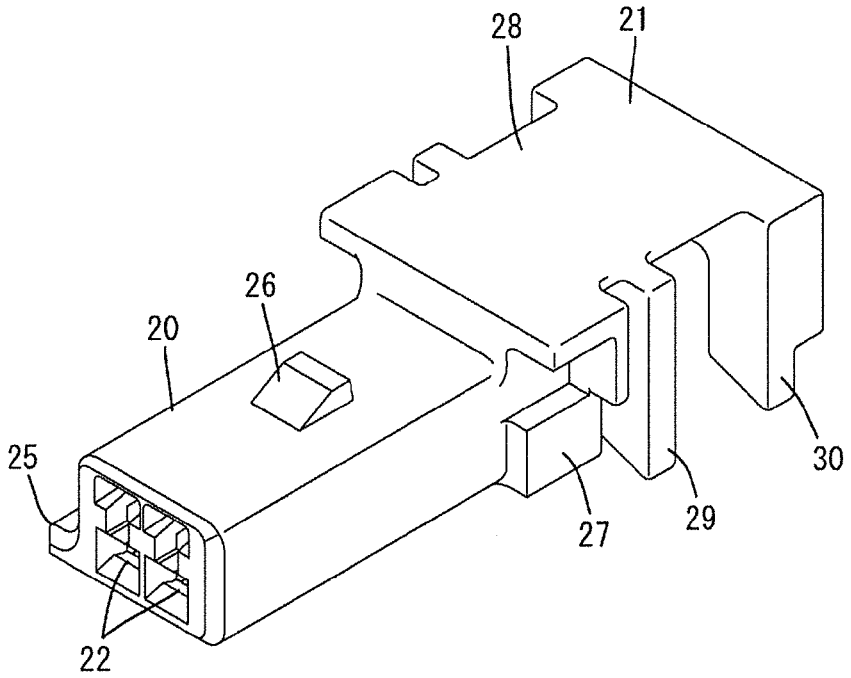
FIG. 7 is a perspective view of a housing.

As shown in FIG. 7, the housing 20 is substantially in the form of a rectangular block long and narrow in the front-back direction and fittable into the receptacle 81 of the mating housing 80. Cavities 22 into which the terminal fittings 60 are insertable are formed inside the housing 20. In this embodiment, pairs of cavities 22 are arranged in parallel in a width direction. As shown in FIG. 3, a locking lance 23 projects at an inner wall of the cavity 22. The terminal fitting 60 is locked resiliently by the locking lance 23 while being inserted in the cavity 22, thereby being retained and held in the cavity 22. As shown in FIG. 1, in a state where the terminal fittings 60 are inserted in the respective cavities 22, the wires 70 connected to the respective terminal fittings 60 are pulled out from the rear surface (hereinafter, "wire pull-out surface 24") of the housing 20 and led out toward the adjacent housing 20 while being guided by the extra-length adjusting portion 21.

A projecting piece 25 is provided on a front end part of the housing 20 laterally protrudes from a lower end part of one side surface. The projecting piece 25 is fit and inserted into the extended portion 82 of the mating housing 80 during the connection of the two housings 20, 80, thereby avoiding a situation where the two housings 20, 80 are erroneously connected. Further, a lock portion 26 for holding the two housings 20, 80 in a connected state by locking the mating housing 80 projects on the upper surface of the housing 20. Furthermore, as shown in FIGS. 2 and 3, two cover lock receiving portions 27 lockable to cover lock portions 43 of the cover 40 to be described later project on lower parts of the rear ends of opposite side surfaces of the housing 20.

As shown in FIG. 1, the extra-length adjusting portion 21 is connected integrally to a rear end part of the housing 20. Specifically, the extra-length adjusting portion 21 is composed of a base 28 in the form of a flat plate projecting back from the rear end of the housing 20 and protruding toward opposite widthwise sides, two partitions 29 projecting down from opposite widthwise ends of a front end side of the base 28 and two supports 30 projecting down from opposite widthwise ends of a rear end side of the base 28.

Figure 4:
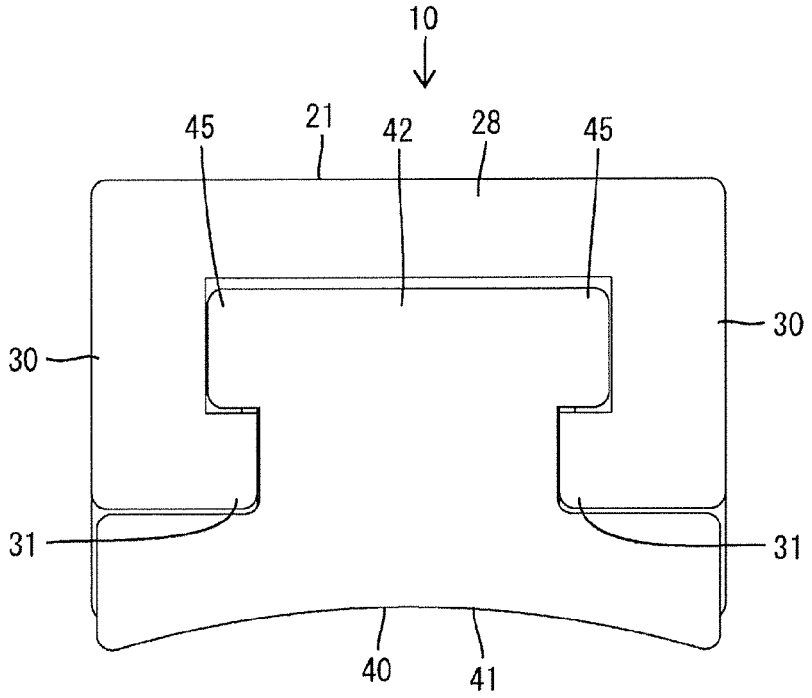
FIG. 4 is a rear view of the connector.
Figure 5:
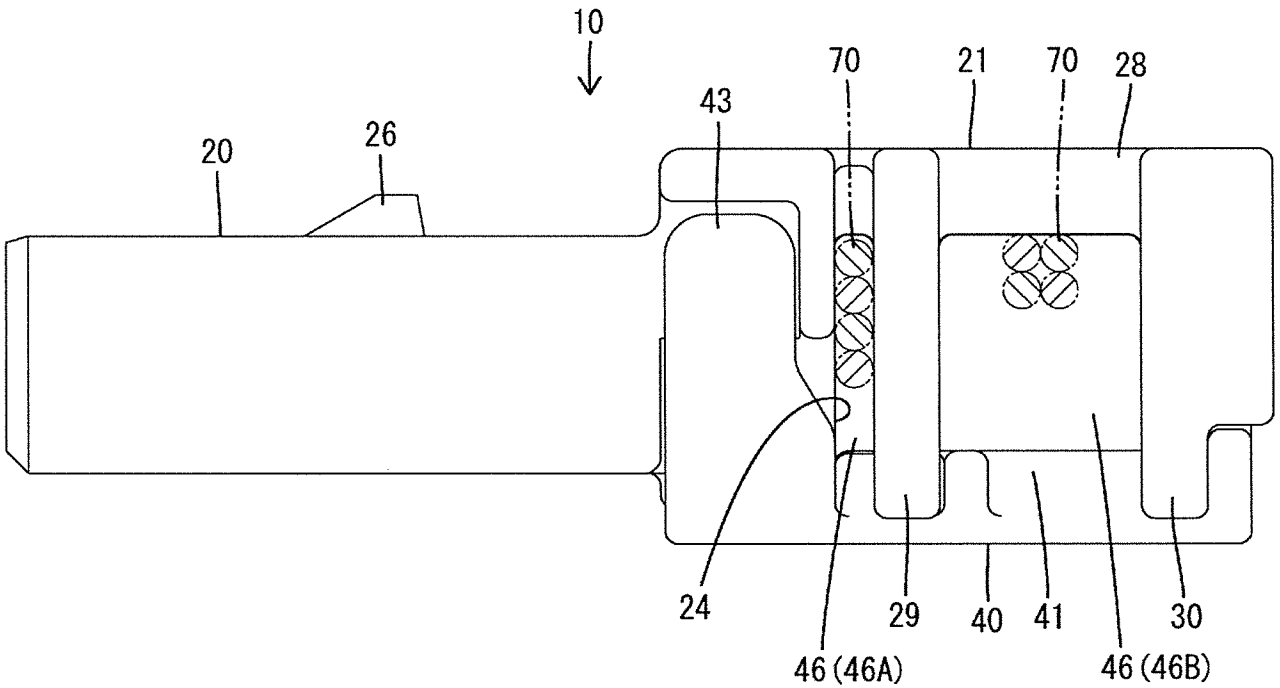
FIG. 5 is a side view of the connector.

The partitions 29 are in the form of strip plates and face the wire pull-out surface 24 of the housing 20 from behind while defining an opening of a dimension in the front-back direction capable of accommodating one wire 70 between the wire pull-out surface 24 and the partitions 29, as shown in FIG. 5. The supports 30 are likewise in the form of strip plates and face the partitions 29 from behind while defining an opening of a dimension in the front-back direction capable of accommodating a plurality of wires 70 between the partitions 29 and the supports 30. Further, as shown in FIG. 4, two inner projecting portions 31 project inwardly toward each other on lower end parts of the supports 30.

Figure 2:
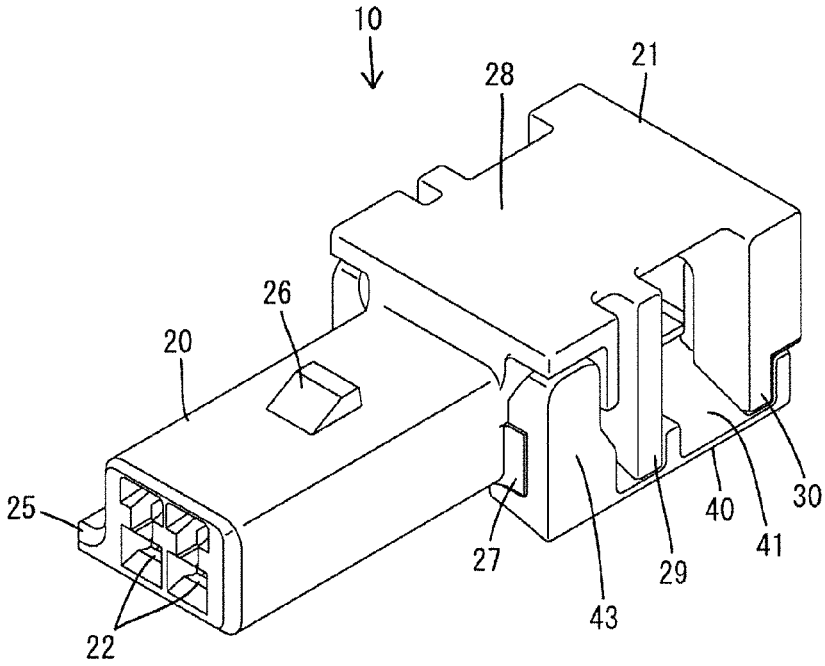
FIG. 2 is a perspective view of the connector.
Figure 6:
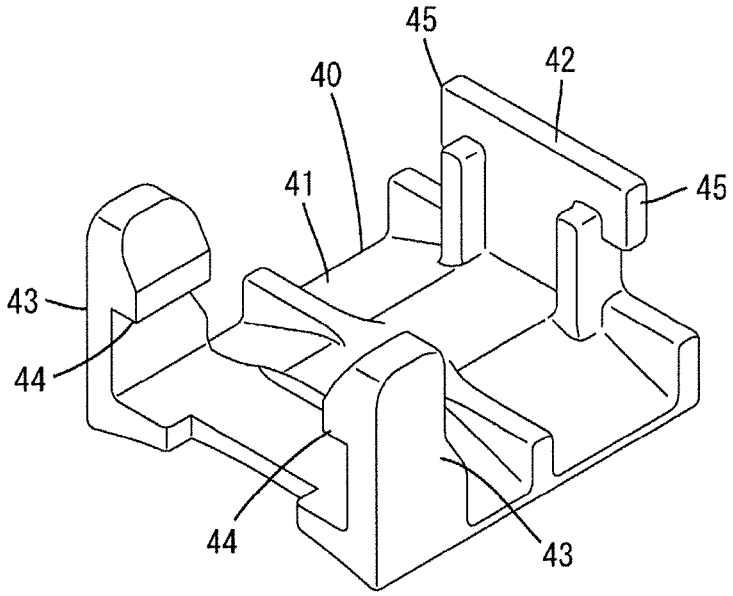
FIG. 6 is a perspective view of a cover.

As shown in FIG. 2, the cover 40 is mounted behind the housing 20 and below the extra-length adjusting portion 21. Specifically, as shown in FIGS. 5 and 6, the cover 40 includes a facing base 41 arranged to face the base 28 from below during mounting, a back plate 42 projecting up from a widthwise central part of the rear end of the facing base 41 and the two cover lock portions 43 projecting up from opposite widthwise ends of the front end of the facing base 41. As shown in FIG. 3, claw-like locking projections 44 project inwardly on the upper ends of the cover lock portions 43. As shown in FIG. 4, two outer projecting portions 45 protrude toward opposite widthwise sides on the upper end of the back plate 42. During mounting, the cover 40 is held on the housing 20 and the extra-length adjusting portion 21 by bringing the inner projecting portions 31 and the outer projecting portions 45 in a state where the outer projecting portions 45 are hooked to the inner projecting portions 31 into contact to retain the cover 40.

Further, a through portion 46 is defined and formed among the cover 40, the housing 20 and the extra-length adjusting portion 21 and penetrates in the width direction. The through portion 46 is divided into two front and rear chambers via the partitions 29 at an inner side of the extra-length adjusting portion 21, the front chamber serves as a first through portion 46A in which the wires 70 can be arranged densely in a row in a height direction (vertical direction) and the rear chamber serves as a second through portion 46B in which the wires 70 can be arranged in a substantially scattered manner in the height direction and the front-back direction. The second through portion 46B is defined between the partitions 29 and the supports 30.

As shown in FIG. 1, a plurality of the housings 20 are arranged side by side in the width direction (direction intersecting with a connecting direction of the two housings 20, 80) so that the housing 20 is arranged at a position right opposite to the mating housing 80 during connection. Further, the wires 70 pulled out from the wire pull-out surface 24 of each housing 20 are arranged to extend in the width direction through the through portion 46 of each housing 20.

Specifically, as shown in FIG. 1, the wire 70 includes a first extended portion 71 that enters the first through portion 46A from the wire pull-out surface 24 of the housing 20 and extends in a first width direction (left in FIG. 1) that intersects the connecting direction of the two housings 20, 80) and an extended end of which is arranged to be exposed outside the first through portion (left side in FIG. 1), a turned portion 72 that is turned into a substantially U shape to pass around the left partition 29, as shown in FIG. 1, at the extended end of the first extended portion 71 and a second extended portion 73 that enters the second through portion 46B from the turned portion 72 and extends in a second direction (right in FIG. 1) out of the opposite width directions. The second extended portion 73 of the wire 70 extends in the second direction through a right opening of the second through portion 46B as shown in FIG. 1, passes through the through portion 46 of the adjacent housing 20 and extend substantially straight to be able to enter the through portion 46 of the further adjacent housing 20.

Here, the connection of the housing 20 to the mating housing 80 needs to be started in a state where the housing 20 is facing right opposite to the corresponding mating housing 80. In that respect, in the case of the embodiment, the wires 70 are held with a margin in the extra-length adjusting portion 21 as shown in FIG. 1 and the lengths of the wires 70 in the connector 10 can be adjusted in the extra-length adjusting portion 21. Specifically, for example, if the housing 20 is displaced to the right of FIG. 1 from a proper connection position to the mating housing 80, the housing 20 is arranged right opposite to the mating housing 80 in a state where the second extended portions 73 of the wires 70 are pressed into contact with the supporting portions 30 and projecting amounts (amounts of loosening of the margin parts 75) of margin parts 75 (turned portions 72 and extended end sides of the first and second extended portions 71, 73) loosened into a substantially U shape projecting to the left of the connector 10 as shown in FIG. 1 are increased largely. Further, for example, if the housing 20 is displaced to the left of FIG. 1 from the proper connection position to the mating housing 80, the housing 20 is arranged right opposite to the mating housing 80 in a state where the second extended portions 73 of the wires 70 are pressed into contact with the supporting portions 30 and the projecting amounts (amounts of loosening of the margin parts 75) of the substantially U-shaped margin parts 75 are reduced.

As just described, wire parts (parts of the second extended portions 73) arranged between the adjacent housings 20 are arranged without excessively tensioned or loosened by adjusting the lengths of the wires 70 in the extra-length adjusting portion 21. As a result, when the connection of the housing 20 to the mating housing 80 is started, the connecting operation can quickly and smoothly proceed. Particularly, in the case of the embodiment, the solenoid shown in FIG. 8 is angularly displaced about an axis, whereby the mating housing 80 is displaced in that angular displacement direction (X or Y direction of FIG. 8) and relative positions of the mating housing 80 and the housing 20 are changed easily. Thus, an advantage of being able to adjust the margin parts 75 of the wires 70 by the extra-length adjusting portion 21 is large.

In addition, the wires 70 passed through the through portion 46 of each housing 20 have rigidity capable of maintaining linearity in the width direction intersecting with the front-back direction and have a function as an aligning member. Thus, the housing 20 is arranged more satisfactorily at the position right opposite to the mating housing 80 during connection.

As described above, according to the embodiment, the amount of loosening of the margin parts 75 of the wires 70 in the connector 10 is adjusted variably adjusted by the extra-length adjusting portion 21 and held by the supports 30. Thus, the lengths of the wires 70 arranged between two connectors 10 adjacent to each other are adjusted properly. As a result, a state where the housing 20 is facing right opposite to the mating housing 80 during connection can be ensured and the connecting operation of the housing 20 and the mating housing 80 can proceed smoothly.

Further, since the extra-length adjusting portion 21 is provided with the supports 30 configured to contact the wires 70 against resilient restoring forces of the wires 70, the loose or wound state of the wires 70 in the extra-length adjusting portion 21 can be maintained reliably by the supports 30.

Furthermore, since the first extended portions 71 and the second extended portions 73 of the wires 70 are partitioned by the partitioning portions 29, a situation where the first and second extended portions 71, 73 are mixed is avoided. In addition, since the extra-length adjusting portion 21 of the housing 20 includes the through portion 46 through which the wires 70 pulled out from the wire pull-out surface 24 of the other housing 20 arranged in parallel are passed, the respective wires 70 are arranged collectively in a compact manner in the extra-length adjusting portion 21.

Other embodiments of the present invention are described below.

Figure 9:
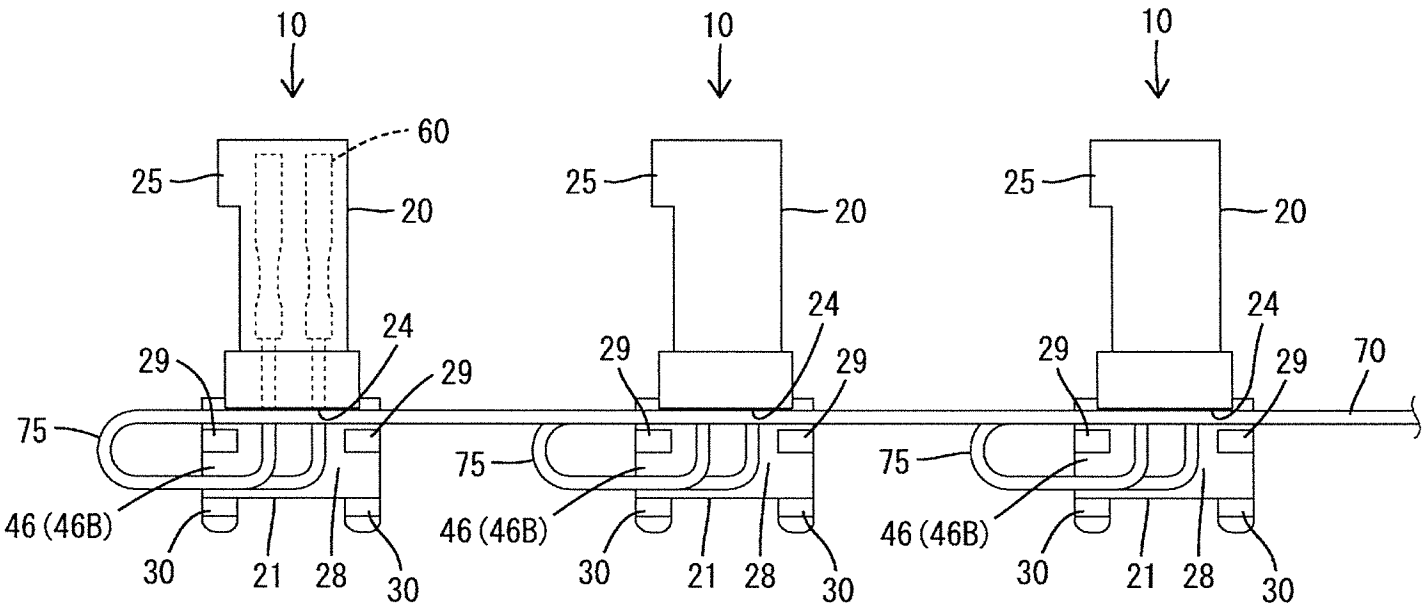
FIG. 9 is a view, corresponding to FIG. 1, of another embodiment of the present invention.

As shown in FIG. 9, the margin parts 75 of the wires 70 may be held in a state wound one or more turns around the partitioning portion 29 or the supporting portion 30 of the extra-length adjusting portion 21 and the amounts of winding thereof may be variably adjustable. In the case shown in FIG. 9, the margin parts 75 of the wires 70 are wound one turn around the partition 29 and a winding direction of the wires 70 extending to the adjacent housing 20 on the right side is set to be a clockwise direction in a bottom view. Note that since the connector 10 shown in FIG. 9 is configured similarly to the connector 10 of the above connector, the same reference signs are given.

The cover may be structured to be integrally coupled to the housing and the extra-length adjusting portion. Depending on cases, the cover may be omitted from the connector.

The margin parts of the wires may be accommodated entirely in the extra-length adjusting portion and the cover.

The partition or the support may be in the form of a flat plate extending in the width direction.

The invention claimed is:

1. A wiring harness including a plurality of connectors having a connector structure with:

a housing in which a terminal fitting is to be accommodated;

a wire to be connected to the terminal fitting and pulled out from a wire pull-out surface of the housing; and an extra-length adjusting portion provided continuously to the housing and configured to hold the wire pulled out from the wire pull-out surface in a state where the wire is loosened into a substantially U shape or wounded one or more turns and variably adjust the amount of loosening or winding of the wire, wherein the plurality of connectors are arranged in parallel with a connecting direction of the housing and a mating housing, the connectors are spaced apart in a direction intersecting the connecting direction and the extra-length adjusting portion of a first of the connectors has an area for holding the wire pulled out from the wire pull-out surface of the housing of the first connector and an area for allowing the passage of the wire pulled out from the wire pull-out surface of the housing of a second of the connectors.

2. The wiring harness of claim 1, wherein the extra-length adjusting portion includes a supporting portion configured to come into contact with the wire against a resilient restoring force of the wire.

3. The wiring harness of claim 1, wherein the wire includes, in the extra-length adjusting portion, a first extended portion extending in a first direction intersecting with the connecting direction of the housing and a mating housing and a second extended portion turned at an extended end of the first extended portion and extending in a second direction opposite to the first direction, and the extra-length adjusting portion includes a partitioning portion configured to partition between the first and second extended portions.

4. The wiring harness of claim 3, wherein the extra-length adjusting portion is composed of a base portion projecting from the housing, the partitioning portion projecting from a base end side of the base portion in a projecting direction while facing the wire pull-out surface, and a supporting portion configured to project from a tip side of the base portion in the projecting direction while facing the wire pull-out surface and come into contact with the wire against a resilient restoring force of the wire.

5. The wiring harness of claim 4, wherein the wires have rigidity capable of maintaining linearity and serve as an aligning member configured to align each of the plurality of connectors at a position right opposite to the mating housing.

* * * * *